US007241932B2

(12) United States Patent
Maddrell

(10) Patent No.: US 7,241,932 B2
(45) Date of Patent: Jul. 10, 2007

(54) ENCAPSULATION OF RADIOACTIVE WASTE USING A SODIUM SILICATE BASED GLASS MATRIX

(75) Inventor: Ewan Robert Maddrell, Cumbria (GB)

(73) Assignee: British Nuclear Fuels PLC (GB)

( * ) Notice: Subject to any disclaimer, the term of this patent is extended or adjusted under 35 U.S.C. 154(b) by 344 days.

(21) Appl. No.: 10/485,926

(22) PCT Filed: Jul. 22, 2002

(86) PCT No.: PCT/GB02/03322

§ 371 (c)(1),
(2), (4) Date: Aug. 3, 2004

(87) PCT Pub. No.: WO03/015106

PCT Pub. Date: Feb. 20, 2003

(65) Prior Publication Data

US 2004/0267080 A1 Dec. 30, 2004

(30) Foreign Application Priority Data

Aug. 3, 2001 (GB) ..... 0118945.5

(51) Int. Cl.
*G21F 9/34* (2006.01)

(52) U.S. Cl. ..... 588/11; 588/15; 588/19

(58) Field of Classification Search ..... 588/11, 588/15, 19, 2, 9
See application file for complete search history.

(56) References Cited

U.S. PATENT DOCUMENTS 3,849,330 A 11/1974 Isaacson et al.
4,234,449 A 11/1980 Wolson et al.
4,404,129 A 9/1983 Penberthy et al.
4,726,916 A 2/1988 Aubert et al.
5,774,815 A 6/1998 Christian et al.
6,023,006 A * 2/2000 Fiquet et al. ..... 588/2

FOREIGN PATENT DOCUMENTS

EP 0 043 643 A1 1/1982
GB 1 588 350 4/1981
WO WO 98/01867 * 1/1998

OTHER PUBLICATIONS

Patent Abstracts of Japan, Publication No. 07270596, Application No. 06060714 (1 page).
International Search Report (4 pages).

* cited by examiner

*Primary Examiner*—Wayne A. Langel
*Assistant Examiner*—James Fiorito

(57) ABSTRACT

The present invention relates to an immobilizing medium for the encapsulation of radioactive waste. The waste immobilizing medium has a sodium silicate based glass matrix in which there is contained radioactive waste wherein the waste comprises one or more inert metal components and one or more fission products. At least a portion of the inert metal components are dissolved in the glass matrix and increase its durability. As a result, the waste immobilising medium is highly durable and leach resistant and is suitable for long term storage of radioactive waste. The inert metal components preferably comprise iron, nickel and chromium.

29 Claims, No Drawings

ENCAPSULATION OF RADIOACTIVE WASTE USING A SODIUM SILICATE BASED GLASS MATRIX

The present invention relates to an immobilising medium for the encapsulation of radioactive waste.

Nuclear plants generate numerous types of radioactive waste which must be encapsulated for long-term storage. A current scheme for treating waste liquors, for example which arise from decontamination of plants by spraying them with nitric acid, comprises precipitating waste in a flocculent form by adding sodium hydroxide, separating the precipitated floc using ultrafiltration and encapsulating the floc in cement. However, the cemented waste form may not be as leach resistant and the waste loading may not be as high as it would be liked.

It is therefore an object of the invention to provide a waste form which is more leach resistant and/or provides a higher waste loading than the current waste forms.

According to a first aspect of the present invention there is provided a waste immobilising medium having a sodium silicate based glass matrix in which there is contained radioactive waste wherein the waste comprises one or more inert metal components and one or more fission products.

The term inert metal components as used herein means metal components not derived from the irradiated nuclear fuel, i.e. it does not include fission products or actinides. The inert metal components may be metal components derived from the plant. The inert metal components may, for example, originate from the dissolution of stainless steel in the plant as a result of spraying the plant with nitric acid.

The invention is therefore effective for treating waste streams from decontamination of plants rich in inert metal components.

At least a portion of the inert metal components are dissolved in the glass matrix and increase its durability. These inert metal components may be dissolved in the glass matrix up to their solubility limits to impart durability to the glass. As a result, the waste immobilising medium is highly durable and leach resistant and is suitable for long term storage of radioactive waste. It has been found that the leach resistance of the waste immobilising medium according to the present invention is better than for borosilicate glasses currently in use.

The inert metal components preferably comprise iron, nickel and chromium. The inert metal components may also comprise other metals e.g. zinc.

The waste may also comprise one or more phosphates. The waste may also comprise one or more other anions; e.g. it may comprise one or more sulphates.

Preferably, the waste comprises up to 10% fission products and at least 90% inert metal components calculated using the masses of the oxides of the fission products and the inert metal components.

Typically, the amount of fission products will be much less than 10%.

Preferably, at least 90% of the waste calculated as above comprises iron, nickel, chromium and, optionally, zinc.

Further preferably at least 90% of the waste calculated as above comprises iron, nickel and chromium.

The waste immobilising medium has a waste loading of up to about 90 weight %. Preferably, the waste loading is from about 80 weight % to about 90 weight %. Waste loading is defined as the mass of waste/total mass of waste immobilising medium, which is the same as mass of waste/

(mass of waste+ mass of additives). Maximising the waste loading thereby minimises the final volume of the waste form.

The sodium silicate glass matrix efficiently acts as a host for the fission products and any actinide elements which are present in the waste. For example, caesium, barium and strontium may be dissolved in the glass.

The glass preferably comprises a weight ratio of silica to soda of between about 4.5–2.5:1. More preferably the weight ratio is about 4:1.

If a high phosphate level is present in the waste, a rare earth element may be incorporated into the immobilising medium in order to precipitate monazite. Typical rare earth elements which may be used include lanthanum, neodymium or cerium. Lanthanum is preferred. The function of the monazite phase is to immobilise phosphate which would otherwise cause phase separation in the sodium silicate glass.

The immobilising medium may use sodium which may be in the waste to provide at least some of the sodium used to form the sodium silicate glass.

According to a second aspect of the present invention there is provided a method of preparing the waste immobilising medium according to the first aspect of the invention, the method including the steps of forming a mixture comprising the radioactive waste, a sodium containing precursor, and silica;

drying the mixture;

calcining the dried mixture; and pressing and sintering the calcined mixture.

The amounts of the sodium containing precursor and silica are adjusted so that a sodium silicate glass is formed in the final waste immobilising medium.

The radioactive waste is typically provided in the form of a waste liquor.

The waste liquor may contain a sodium-containing component. Thus, the waste liquor may provide at least some of the sodium for forming the sodium silicate glass matrix.

The sodium containing precursor may be sodium oxide ($Na_2O$) or, preferably, sodium silicate.

A preferred precursor composition which is added to the waste to form the mixture comprises a glass frit of about 20 weight % soda ($Na_2O$) and about 80 weight % silica ($SiO_2$)

A rare earth element e.g. lanthanum may be include in the mixture to enable formation of the monazite where there is phosphate in the waste. The rare earth element may be added in the form of the oxide, e.g. $La_2O_3$.

Because of the use of nitric acid in nuclear plants, many of the waste components in the waste may be present in the form of nitrates.

Preferably, such waste liquor is denitrated before or whilst forming the mixture. This makes further processing easier. If the liquor is not denitrated, an undesirable sludge or paste may be formed in the mixture which may be difficult to dry effectively.

The denitration may be performed in one of many ways. A preferred method of denitration comprises reacting the liquor with formaldehyde. After denitration, the liquor remains as a substantially liquid phase.

Mixing of the components in the mixture is effected typically by stirring. Stirring ensures homogeneity in the mixture. Other methods of homogeneously mixing may be used.

After the mixture has been formed and sufficiently mixed, the mixture is dried. The drying may be carried out by one of many methods known to the skilled person in the art.

After the mixture has been dried, it is calcined to form a powder. The calcination may be carried out in a neutral (e.g. with $N_2$ gas) or reducing atmosphere. The reducing atmosphere may comprise an $Ar/H_2$ mixture or a $N_2/H_2$ mixture. The hydrogen is typically diluted to 10% or less in the inert gas. For example, a 5% mixture of $H_2$ in $N_2$ may be used.

The calcination may be carried out between 650–800° C. Typically, about 750° C. may be used.

Optionally, the calcined powder, particularly powder calcined in an $N_2/H_2$ mixture, may be mixed with an oxygen getter prior to compaction and sintering. The oxygen getter may be a metal. For example, metallic titanium is an effective getter.

Where a metal getter is used, e.g. titanium, it may be present in the powder in an amount of, for example, about 2 wt %.

Finally, the calcined powder is compacted and sintered to produce the final immobilising medium suitable for long term storage.

The compaction and sintering may be carried out according to known methods such as Hot Uniaxial Pressing or Hot Isostatic Pressing (HIP). HIP is preferred. Preferably the temperature for HIP is 1000–1400° C. More preferably the temperature for HIP is 1100–1300° C.

The invention claimed is:

1. A waste immobilising medium having a sodium silicate based glass matrix in which there is contained radioactive waste at a waste loading from about 80 weight % to about 90 weight % wherein the waste comprises at least 90% of a first metals containing component wherein the metals include iron, nickel and chromium, and up to 10% of a second component containing one or more fission products, these % being calculated using the masses of the oxides of the metals of the first component and of the fission products respectively.

2. A waste immobilising medium according to claim 1 wherein at least a portion of the first component is dissolved in the glass matrix.

3. A waste immobilising medium according to claim 2 wherein the metals of the first component are dissolved in the glass matrix up to their solubility limits.

4. A waste immobilising medium according to claim 1 wherein at least 90% of the waste calculated as above is comprised of iron, nickel, chromium and zinc.

5. A waste immobilising medium according to claim 1 wherein at least 90% of the waste calculated as above is comprised of iron, nickel and chromium.

6. A waste immobilising medium according to claim 1 wherein the glass comprises a weight ratio of silica to sodium oxide of between about 4.5–2.5:1.

7. A waste immobilising medium according to claim 6 wherein the weight ratio is about 4:1.

8. A waste immobilising medium according to claim 1 wherein there is a monazite phase.

9. A method of preparing a waste immobilising medium including the steps of forming a mixture comprising radioactive waste, a sodium containing precursor and silica, wherein the waste comprises at least 90% of a first metals containing component wherein the metals include iron, nickel and chromium, and unto 10% of a second component containing one or more fission products, these % being calculated using the masses of the oxides of the metals of the first component and of the fission products respectively;

drying the mixture;

calcining the dried mixture; and pressing and sintering the calcined mixture so that the resulting medium contains from about 80 weight % to about 90 weight % of radioactive waste.

10. A method according to claim 9 wherein the sodium containing precursor is sodium oxide ($Na_2O$) or sodium silicate.

11. A method according to claim 9 wherein the mixture is formed between the waste and a composition which comprises a glass frit of about 20 weight % sodium oxide ($Na_2O$) and about 80 weight % silica ($SiO_2$).

12. A method according to claim 9 wherein a rare earth element is included in the mixture.

13. A method according to claim 9 wherein the waste is denitrated before or whilst forming the mixture.

14. A method according to claim 9 wherein the calcination is carried out in a neutral or reducing atmosphere.

15. A method according to claim 9 wherein the calcination is carried out between 650–800° C., preferably about 750° C.

16. A method according to claim 9 wherein the compaction and sintering is carried out by hot uniaxial pressing or hot isostatic pressing.

17. A method according to claim 16 wherein the temperature for hot isostatic pressing is 1000–1400° C.

18. A method of treating radioactive waste streams from the decontamination of plants, said streams comprising at least 90% of oxides of iron, nickel and chromium as well as one or more fission products, the method including the steps of forming a mixture comprising the radioactive waste, a sodium containing precursor, and silica;

drying the mixture;

calcining the dried mixture; and pressing and sintering the calcined mixture to provide a sodium silicate glass based matrix.

19. A method according to claim 18 wherein the sodium containing precursor is sodium oxide ($Na_2O$) or sodium silicate.

20. A method according to claim 18 wherein the mixture is formed between the waste and a composition which comprises a glass frit of about 20 weight % sodium oxide ($Na_2O$) and about 80 weight % silica ($SiO_2$).

21. A method according to claim 18 wherein a rare earth element is included in the mixture.

22. A method according to claim 18 wherein the waste is denitrated before or whilst forming the mixture.

23. A method according to claim 18 wherein the calcination is carried out in a neutral or reducing atmosphere.

24. A method according to claim 18 wherein the calcination is carried out between 650–800° C., preferably about 750° C.

25. A method according to claim 18 wherein the compaction and sintering is carried out by hot uniaxial pressing or hot isostatic pressing.

26. A method according to claim 25 wherein the temperature for hot isostatic pressing is 1000–1400° C.

27. A waste immobilising medium having a sodium silicate based glass matrix in which there is contained radioactive waste wherein the waste comprises at least 90% of a first metals containing component and up to 10% of a second component including one or more fission products calculated using the masses of the oxides of the fission products and of the metals of the first component, wherein the metals include iron, nickel and chromium, and, optionally, zinc, the metals of the first component being dissolved in the glass matrix up to their solubility limits, and wherein the glass comprises a weight ratio of silica to sodium oxide of between about 4.5–2.5:1.

28. A waste immobilising medium according to claim 27 wherein there is a monazite phase.

29. A method of treating radioactive waste streams from the decontamination of plants, said streams comprising at least 90% of oxides of iron, nickel and chromium as well as one or more fission products, the method including the steps of forming a mixture comprising the radioactive waste and a glass flit of about 20 weight % sodium oxide ($Na_2O$) and about 80 weight % silica ($SiO_2$), optionally with the inclusion of a rare earth element;

drying the mixture;

calcining the dried mixture between 650–800° C.; and pressing and sintering the calcined mixture by hot uniaxial pressing or hot isostatic pressing to provide a sodium silicate glass based matrix.

* * * * *

UNITED STATES PATENT AND TRADEMARK OFFICE

CERTIFICATE OF CORRECTION

PATENT NO. : 7,241,932 B2
APPLICATION NO. : 10/485926
DATED : July 10, 2007
INVENTOR(S) : Ewan R. Maddrell It is certified that error appears in the above-identified patent and that said Letters Patent is hereby corrected as shown below:

Column 3, line 61, “unto” should be --up to--.

Column 6, line 2, “flit” should be --frit--.

Signed and Sealed this

Sixteenth Day of October, 2007

JON W. DUDAS
*Director of the United States Patent and Trademark Office*